US005690263A

United States Patent [19]

Abba et al.

[11] Patent Number: 5,690,263

[45] Date of Patent: Nov. 25, 1997

[54] METHOD FOR APPLYING A TRACTIVE FORCE TO A STACK OF TISSUES WITH REDUCED BULK LOSS

[75] Inventors: Rodney Lawrence Abba, Oshkosh; Scott Allen Baum, Fremont, both of Wis.

[73] Assignee: Kimberly-Clark Worldwide, Inc., Neenah, Wis.

[21] Appl. No.: 659,809

[22] Filed: Jun. 7, 1996

Related U.S. Application Data

[63] Continuation of Ser. No. 196,608, Feb. 15, 1994, abandoned.

[51] Int. Cl.[6] ..... B65H 20/06

[52] U.S. Cl. ..... 226/1; 226/172

[58] Field of Search ..... 226/1, 171, 172, 226/173, 193, 53; 198/604, 620, 626.1

[56] References Cited

U.S. PATENT DOCUMENTS

| | | | |
|---|---|---|---|
| 417,065 | 12/1889 | Miller . | |
| 1,904,885 | 4/1933 | Seeley | 226/172 |
| 3,841,620 | 10/1974 | Lee et al. | 270/40 |
| 3,844,398 | 10/1974 | Pinant | 226/172 X |
| 3,853,016 | 12/1974 | Lane, III et al. | 74/231 C |
| 3,857,475 | 12/1974 | Smith | 198/137 |
| 3,880,274 | 4/1975 | Bechtloff et al. | 226/172 X |
| 3,946,918 | 3/1976 | Babbin et al. | 226/172 X |
| 4,039,109 | 8/1977 | Rhodes | 226/172 |
| 4,055,003 | 10/1977 | Sack | 226/97 X |
| 4,984,728 | 1/1991 | Brinkmeir et al. | 226/172 |

FOREIGN PATENT DOCUMENTS

| | | |
|---|---|---|
| 970224 | 1/1951 | France . |
| 2636363 | 2/1977 | Germany . |
| 0032595 | 3/1977 | Japan . |
| 0043406 | 2/1989 | Japan . |

*Primary Examiner*—John P. Darling
*Attorney, Agent, or Firm*—Gregory E. Croft

[57] ABSTRACT

During tissue converting operations, a tissue "sausage" is conveyed between a pair of converging tractive belts to a cut-off saw where the sausage is cut into individual clips of tissue. Tissue bulk is preserved by providing the tissue-contacting surfaces of the belts with spaced-apart protrusions which cause the tissue sausage to assume a profile approximating a sine wave. The sine wave profile increases the tractive force of the belts, which in turn allows a lowering of the compressive load exerted by the belts on the tissue sausage. As a result, the bulk loss of the tissue sheets within the sausage is reduced.

19 Claims, 4 Drawing Sheets

METHOD FOR APPLYING A TRACTIVE FORCE TO A STACK OF TISSUES WITH REDUCED BULK LOSS

This application is a continuation of application Ser. No. 08/196,608 entitled "Method For Applying A Tractive Force To A Stack of Tissue With Reduced Bulk Loss", and filed in the U.S. Patent and Trademark Office on Feb. 15, 1994, now abandoned.

BACKGROUND OF THE INVENTION

This invention relates to tissue converting in general, and particularly to the movement of folded, stacked tissue webs through converting equipment. Such movement is typically required after the folding section and during transport through the saw section of a facial tissue converting line.

During facial tissue converting, a slit tissue web of the appropriate width is continuously unwound from a roll, redirected by means of a turning bar, folded and laid down onto previously folded tissue webs to form a continuous stack of tissues. These operations are carried out in a machine referred to as a multifolder. The resulting stack of tissues is commonly referred to as a "sausage". The number of tissues within the sausage equals the desired sheet count within the carton for the product being made.

The motive force for the sausage is provided by a converging flat belt pull section. In this section, tractive forces are applied to the sausage by compressing it between two flat moving belts. The compression of the sausage is necessary to develop sufficient friction between the surfaces of the belts and the tissues in order to pull/push the sausage along. Since the surface of the sausage is essentially planar, the necessary tractive force is determined by the normal (compressive) load applied to the sausage by the belts and the coefficient of friction between the tissue and the belt surfaces. During tissue converting operations, significantly large normal loads are required to generate the necessary tractive forces.

Upon leaving the pull section, the sausage enters a saw section where converging metal lugs hold the material until the saw cuts the sausage into individual tissue stacks. The individual product stacks are conveyed to a cartoner for packaging into cartons. The cartons are packed into boxes which are stacked on pallets and distributed to stores for sale.

The large compressive loads applied to the sausage as it is transported through the pull section permanently densify the tissues within the stack, which leads to a permanent bulk loss. The permanent compression of the bulky, lofty tissue structure results in tissues which are stiffer and have less surface depth. When using such tissues, a user can notice a loss in softness compared to identical tissues not subjected to the large compressive loads.

Hence there is a need for a means of handling tissue sheets during converting operations which has a less deleterious effect on the bulk and softness of the final tissue product.

SUMMARY OF THE INVENTION

The present invention involves a method by which the tractive forces transmitted to tissue sausages can be substantially increased for the same amount of applied normal load. Conversely, the tractive force can remain at a fixed level while the applied normal load is decreased, thus diminishing the reduction in bulk and softness of the final product. For example, it has been determined that a bulk increase of about 17 percent (from 5.8 cubic centimeters per gram to about 6.8 cubic centimeters per gram) can be obtained when conventional flat belts are operated at a gap of 1.4 inches versus a gap of 0.9 inch. Using the method of this invention, similar bulk gains can be achieved without the loss of the tractive forces necessary to pull the sausage through the multifolder machine.

Increased tractive forces are generated by modifying the tissue sausage at points of draw control (pull sections and saws) from an essentially flat profile to an undulating profile similar to that of a sine wave. In the draw section, this can be accomplished by using belts having appropriately-spaced intermeshing lugs or by using belts made having a continuous surface profile. In the saw section, this can be accomplished by positioning the lugs or bars which engage the top surface of the sausage over the spaces between the lugs or bars which engage the bottom surface of the sausage (out of phase by about 180°). Of course, in the saw section, the spacing of the bars must still leave room for the saw blade used to cut the sausage into clips. In either place, by displacing the tissue sausage into an undulating or sinusoidal profile, the tractive forces are enhanced over those created solely by the coefficient of friction between a flat belt and the flat surface of the tissue. This is because in order for the sausage to move relative to the belts when the normal load is reduced, slippage of individual tissues relative to adjacent tissues must occur along with the slippage of the outer tissue surfaces relative to the surfaces of the belts or bars. Tissue-to-tissue slippage occurs as the individual tissue webs are worked around the bends imposed by the protrusions on the belts or bars. Thus the tissue-to-tissue friction within the sausage, along with that of the tissue-to-belt protrusions (draw section) or tissue-to-bars (saw section), combine to greatly enhance the tractive forces generated. This will be described in greater detail with reference to the drawing.

Hence in one aspect, the invention resides in a method of applying a tractive force to a stack of tissues comprising feeding the stack of tissues between two endless converging driven belts travelling in the same direction, each of said belts having a tissue-contacting surface with spaced-apart protrusions positioned in a staggered relationship relative to the protrusions of the other belt such that a sinusoidal profile is imparted to the stack of tissues which provides adequate frictional engagement to move the stack of tissues with the belts without slippage.

The spaced-apart protrusions on the two belts can be provided by lugs attached to the belt(s) or by some other suitable means, such as by specially molded protrusions which are adhered to the surface of the belt or by simply grinding away portions of a thick belt to provide a continuous profile. The spacing and height or depth of the protrusions will depend in part on the thickness of the stack or sausage, the degree of motive force required and the amount of compressive force necessary. For instance, a 90 sheet count product has a clip height of approximately 1.4 inch while a 280 sheet count product has a clip height of about 4.4 inch. This large increase in clip height makes the bending stiffness of the 280 count product much higher than the 90 count product. As a result the wavelength imparted to the sausage by the belt lugs needs to be much greater for the 280 count product. In general, the size and spacing of the protrusions are such that they result in the sausage having a sinusoidal shape with a wavelength of from about 0.5 inch to about 15 inches, more specifically from about 1 inch to about 5 inches, and still more specifically from about 1 to about 2 inches. The sinusoidal wave amplitude can be about 0.1 inch or greater, more specifically from about 0.1 inch to about 3 inches, still more specifically from about 0.2 inch to about 1 inch, and still more specifically about 0.5 inch. The size and spacing of the protrusions on the surfaces of the belts will generally correspond to the foregoing dimensions.

The method of this invention can be applied to either the design of a pull section for a multifolder machine or the draw section for a facial tissue saw. For purposes herein, a "sinusoidal" profile is any undulating profile which is shaped like a sine wave or is similar to a sine wave in form. It can be irregular in frequency and amplitude and is preferably smooth with rounded contours.

DETAILED DESCRIPTION OF THE DRAWINGS

Figure 1:
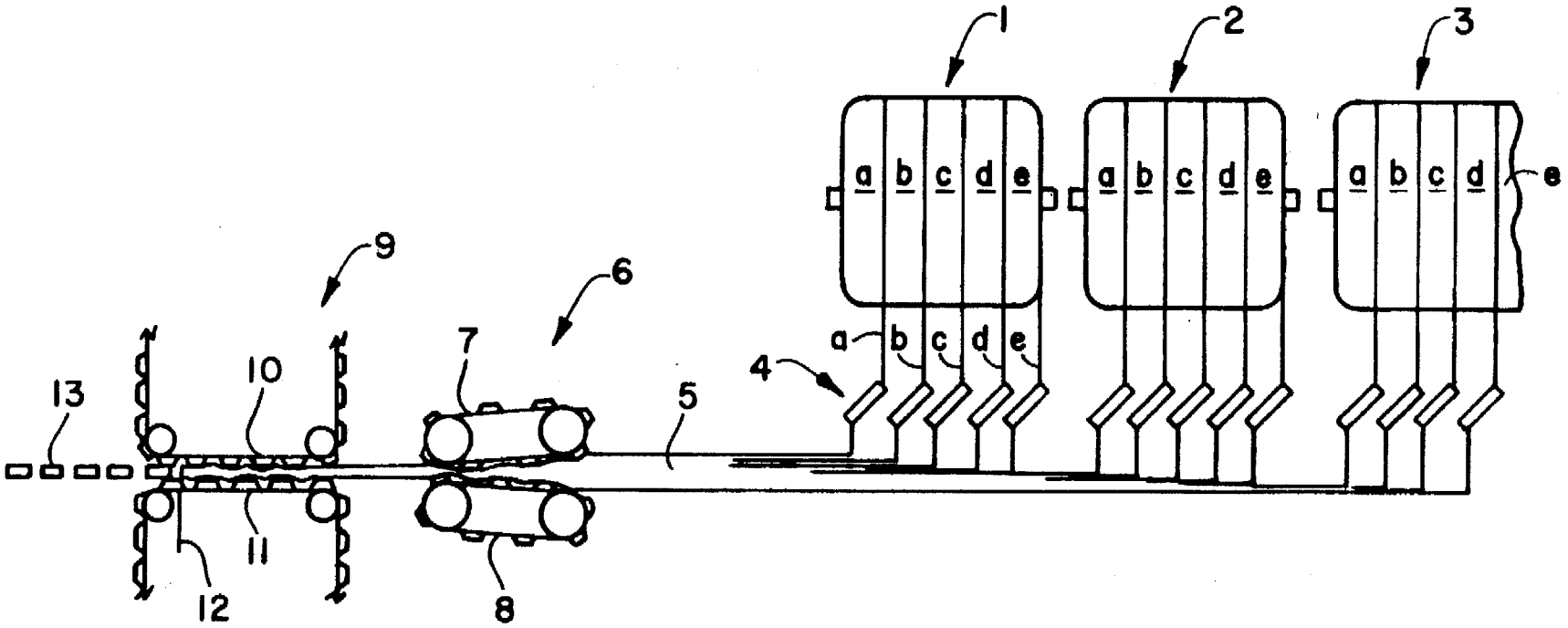
FIG. 1 is a schematic diagram of a portion of a facial tissue converting process using a multifolder machine, illustrating the sausage pull section and the saw section in accordance with this invention.

FIG. 1 shows a schematic diagram of a portion of a facial tissue converting process using a multifolder. Shown are a plurality of unwind rolls 1, 2, and 3, each of which consists of a tissue sheet slit into appropriate widths a, b, c, d, and e for being folded and cut into individual facial tissues. The individual slit tissues (shown as thin lines) are passed over folding boards 4, where the tissues are folded and interfolded with the adjacent tissue and laid down on top of each other to form a continuous "sausage" 5. The sausage is pulled from the unwind rolls by the pull section 6 of the multifolder, which contains a pair of moving belts 7 and 8 which compress the sausage and cause it to move by frictional engagement. The tissue sausage can be further pulled through the saw section 9 using chain belts 10 and 11 having lugs or bars which extend outwardly to the side over and under the sausage as it enters the saw section. The spacing of the bars or lugs is sufficient to accommodate the cylindrical rotating saw blade 12 as it cuts through the sausage. In the saw section, the sausage is cut into clips 13 of tissues, which are subsequently placed in tissue boxes. The tissue boxes are then placed in cartons for shipping.

Figure 2:
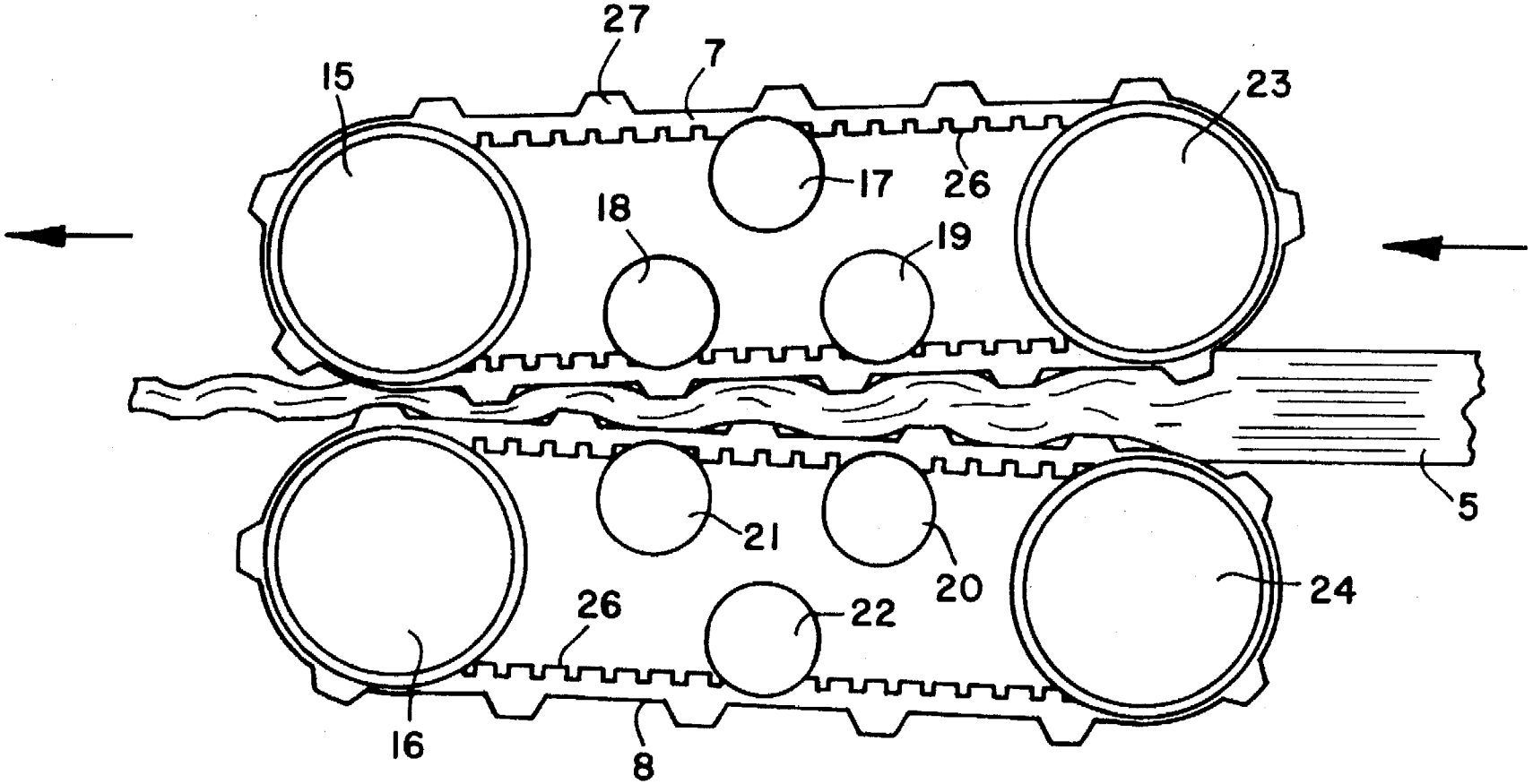
FIG. 2 is a schematic side view of the pull section in accordance with this invention.

FIG. 2 is a schematic cross-sectional view of the pull section of the multifolder machine of FIG. 1, further illustrating the operation of the invention. Shown is the tissue sausage 5 and the two pull belts 7 and 8. Also shown are main toothed timing pulleys 15 and 16 with associated small idler pulleys 17, 18, 19, 20, 21 and 22 and large idler pulleys 23 and 24. The drive to the pull section is such that both toothed pulleys 15 and 16 are driven at the same speed (rpm). The positions of the pulleys are maintained by appropriate side frames which allow for the amount of convergence between the upper belt 7 and the lower belt 8 to be adjusted. The side frame assembly also incorporates the ability for one of the belts to apply a variable normal load relative to the other belt in order to create sufficient friction to pull the sausage. The drive belts 7 and 8 comprise inner timing lugs 26 and outer tractive lugs 27. The inner timing lugs are molded to common discrete profiles used on timing belts to run in conjunction with pulleys 15–24. The outer lug profile can be either continuous or discrete and is designed to maximize the tractive force applied to the sausage. The upper and lower drive belts are indexed so they are out of phase with the other belt by 180°. This causes the tissue sausage to approximate the shape of a sine wave in the region between the upper and lower drive belts. As previously discussed, the sine wave profile of the sausage can, for a given normal load, develop more tractive force before slippage occurs than the customary flat planar belts previously employed. Thus a pull section or saw section which causes the tissue sausage to deform to that of a sine wave can operate at reduced normal loads without tissue sausage slippage occurring. The reduced normal loads will retain more of the incoming tissue's bulk and softness.

Figure 3:
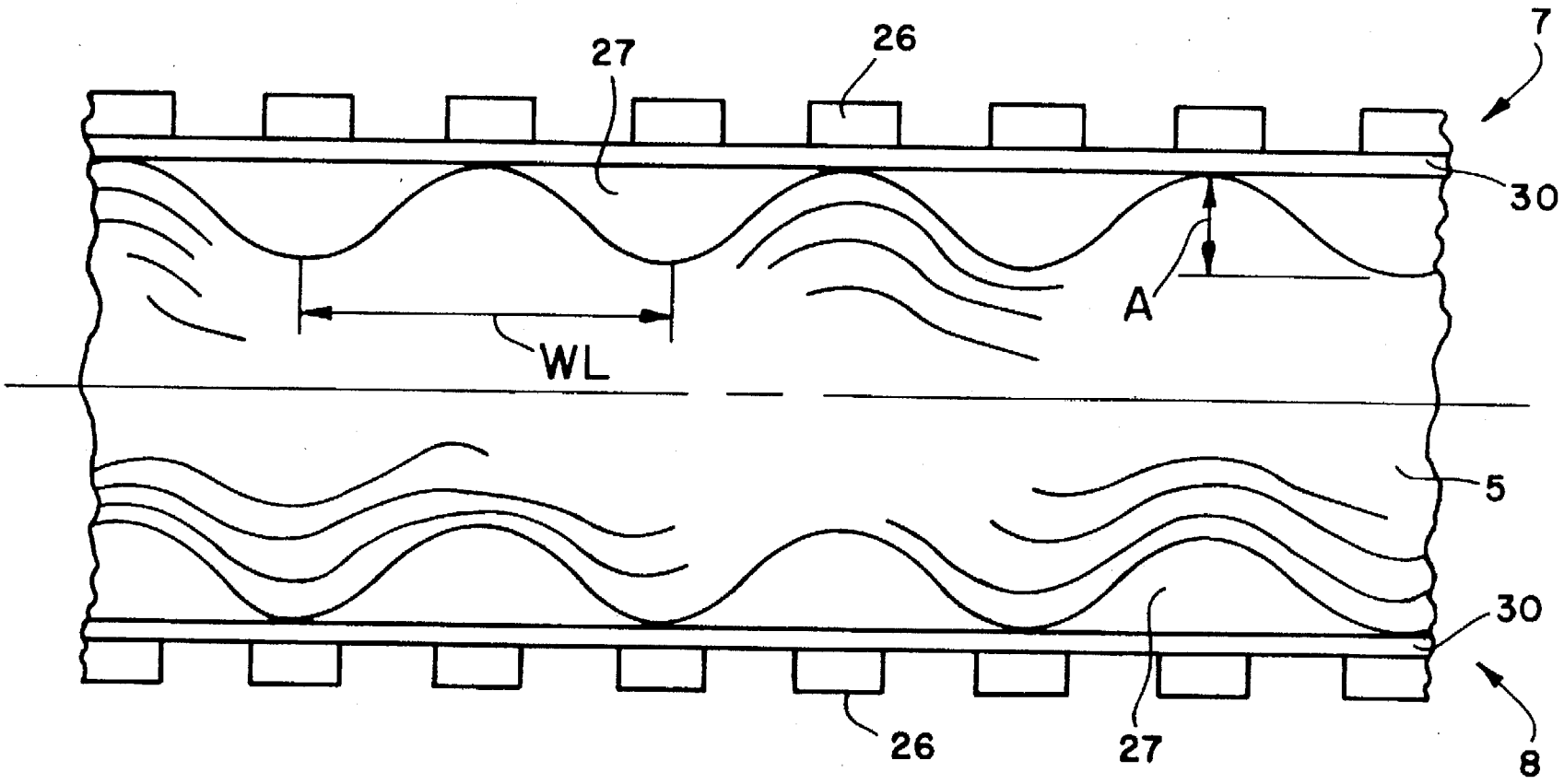
FIG. 3 is a schematic side view of the tissue sausage in contact with the pull section belts in accordance with this invention, illustrating the sinusoidal shape of the sausage.

FIG. 3 is a cross-sectional view of the pull section, similar to that of FIG. 2, but illustrating a more idealized situation in which the tractive forces are provided by belts having a continuous profile rather than discrete tractive lugs. Shown is upper pull section belt 7 comprised of outer tractive lugs 27, timing lugs 26, and center body section 30. The center body section of the belt is designed with standard belting practices and may include cording for additional strength. Lower belt 8 is similarly constructed. As shown upper belt 7 and lower belt 8 are out of phase with each other by 180°, although any phase shift from 0° to 180° will provide a tractive improvement over a flat planar belt. The profile of the outer tractive lugs can be either continuous as shown in FIG. 3 or discrete separate lugs as shown in FIG. 2. The upper and lower belts, when loaded together, cause the tissue sausage to deform to a shape resembling a sine wave between the belts. The geometry of the outer tractive lugs will determine the amplitude "A" and the wavelength "WL" which is assumed by the tissue sausage while contained between the belts. Certain wavelengths, amplitudes, and phase shifts have been found to generate more tractive force than other combinations.

Figure 4:
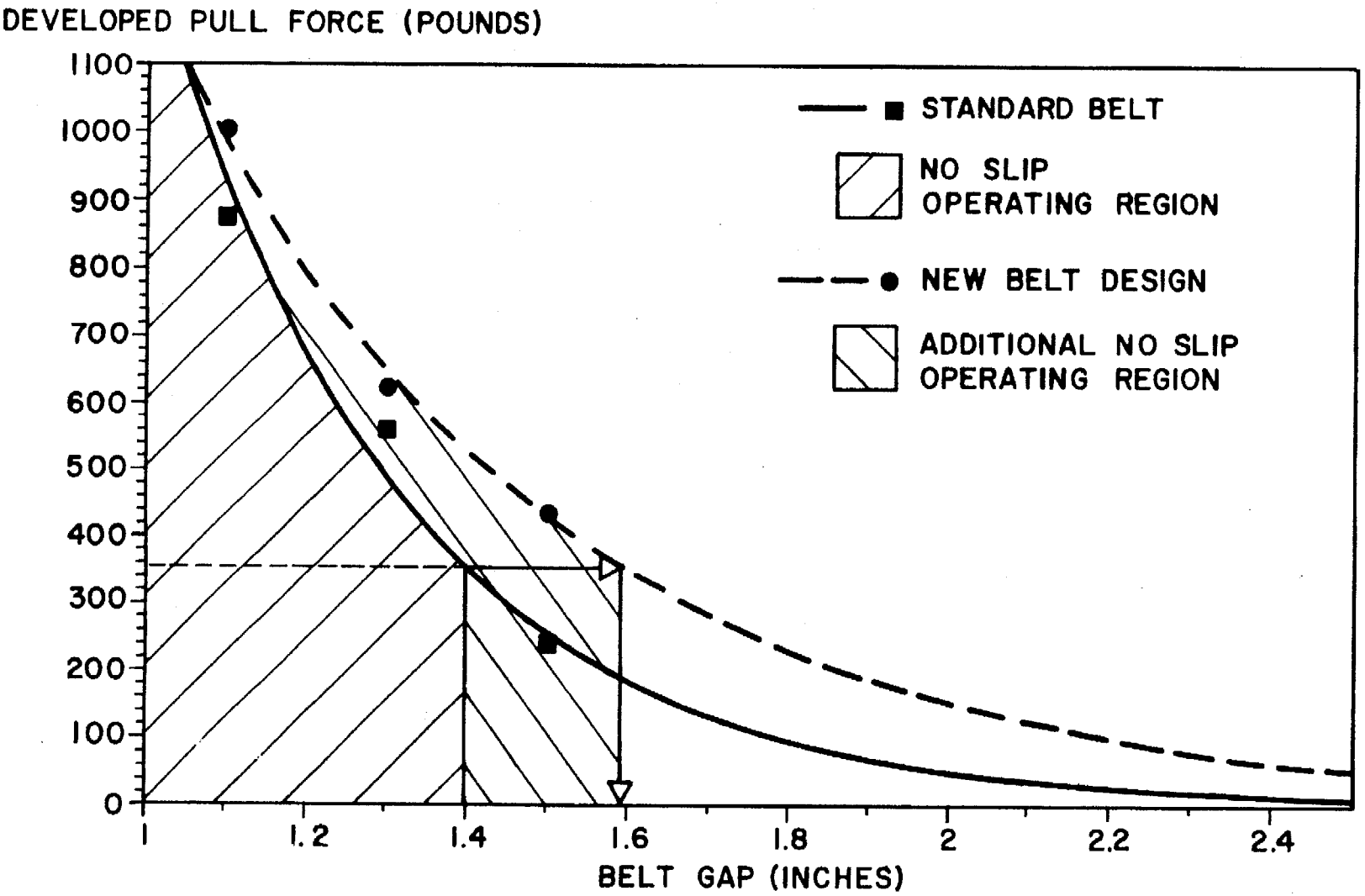
FIG. 4 is a plot of the developed pull force as a function of belt gap for a standard flat belt and the new belt design of this invention, illustrating the increase in pull force obtained for a given belt gap.

FIG. 4 is a plot depicting the generated pull force for a flat planar belt compared to a belt design of this invention which causes the tissue sausage to deform similar to a sine wave in the region between the belts. The conventional flat planar belt is identified as "Standard Belt", while the belt imparting a sine wave profile in accordance with this invention is identified as "New Belt Design". The experimental belt was constructed with discrete lugs having a regular trapezoidal shape as illustrated in FIG. 2 having one base width of 0.3 inch, another base width of 0.5 inch and a height of 0.25 inch. The gap between the belts was varied along the x-axis and the generated pull force or tractive force is scaled along the y-axis. The pull force was determined by gluing the belts to plates, placing a 175 count tissue sausage between the plates, then loading the plates to a fixed gap between the belts. This assembly was then placed in a tensile test machine and the peak force required to pull the sausage out from between the belts recorded. As indicated, the experimental belt had significantly more generated pull force for a given load than the standard belt. At a gap of 1.5" the new belt design of this invention had nearly twice the generated tractive force than the standard belt. Conversely, at a given generated pull force, the new belt design could be operated at a greater belt gap.

It will be appreciated by those skilled in the art that the foregoing Figures and examples, given for purposes of illustration, are not to be construed as limiting the scope of this invention, which is defined by the following claims and all equivalents thereto.

We claim:

1. A method for applying a tractive force to a stack of tissues comprising feeding the stack of tissues between two tissue-contacting surfaces travelling horizontally in the same direction, each of said surfaces having spaced apart protrusions positioned in a staggered relationship relative to the protrusions of the other surface such that a sinusoidal profile is imparted to the stack of tissues which provides adequate frictional engagement to move the stack of tissues without slippage and with less bulk loss compared to moving the stack of tissues between flat belts.

2. The method of claim 1 wherein the two tissue-contacting surfaces are in a saw section of a multifolder machine and comprise opposing series of multiple spaced-apart bars or lugs.

3. The method of claim 1 wherein the two tissue-contacting surfaces are in a saw section of a multifolder machine and comprise opposing series of multiple spaced-apart bars or lugs.

4. The method of claim 1 wherein the sinusoidal profile of the stack of tissues has a wave amplitude of about 0.1 inch or greater.

5. The method of claim 4 wherein the wave amplitude is from about 0.1 inch to about 3 inches.

6. The method of claim 4 wherein the wave amplitude is from about 0.2 inch to about 1 inch.

7. The method of claim 4 wherein the wave amplitude is about 0.5 inch.

8. The method of claim 1 wherein the sinusoidal profile of the stack of tissue has a wavelength of from about 0.25 inch to about 15 inches.

9. The method of claim 8 wherein the wavelength is from about 0.5 inch to about 5 inches.

10. The method of claim 8 wherein the wavelength is from about 1 inch to about 2 inches.

11. A method for applying a tractive force to a stack of tissues comprising feeding the stack of tissues between two endless converging driven belts travelling horizontally in the same direction, each of said belts having a tissue-contacting surface with spaced apart protrusions positioned in a staggered relationship relative to the protrusions of the other belt such that a sinusoidal profile is imparted to the stack of tissues which provides adequate frictional engagement to move the stack of tissues with the belts without slippage and with less bulk loss compared to moving the stack of tissues between conventional flat belts.

12. The method of claim 11 wherein the sinusoidal profile of the stack of tissues has a wave amplitude of about 0.1 inch or greater.

13. The method of claim 12 wherein the wave amplitude is from about 0.1 inch to about 3 inches.

14. The method of claim 12 wherein the wave amplitude is from about 0.2 inch to about 1 inch.

15. The method of claim 12 wherein the wave amplitude is about 0.5 inch.

16. The method of claim 11 wherein the sinusoidal profile of the stack of tissues has a wavelength of from about 0.25 inch to about 15 inches.

17. The method of claim 16 wherein the wavelength is from about 0.5 inch to about 5 inches.

18. The method of claim 16 wherein the wavelength is from about 1 inch to about 2 inches.

19. A method for applying a tractive force to a tissue sausage containing from about 50 to about 400 tissues in a pull section of a multifolder machine comprising feeding the tissue sausage between two endless converging driven belts travelling horizontally in the same direction, each of said belts having a tissue-contacting surface with spaced-apart protrusions positioned in a staggered relationship relative to the protrusions of the other belt such that a sinusoidal profile is imparted to the stack of tissues, said sinusoidal profile having an amplitude of from about 0.1 inch to about 3 inches and a wavelength of from about 0.5 to about 5 inches wherein the tissues within the tissue sausage have less bulk loss compared to moving the stack of tissues between flat belts.

* * * * *